United States Patent [19]

Roling et al.

[11] Patent Number: 4,810,354

[45] Date of Patent: Mar. 7, 1989

[54] BIFUNCTIONAL ANTIFOULANT COMPOSITIONS AND METHODS

[75] Inventors: Paul V. Roling, Spring; Joseph H. Y. Niu; Dwight K. Reid, both of Houston, all of Tex.

[73] Assignee: Betz Laboratories, Inc., Trevose, Pa.

[21] Appl. No.: 926,308

[22] Filed: Oct. 31, 1986

[51] Int. Cl.[4] ..... C10G 21/00

[52] U.S. Cl. ..... 208/48 AA; 208/48 R; 208/255; 208/14; 252/51.5 R; 585/13; 423/DIG. 14

[58] Field of Search ..... 208/48 AA, 14; 252/51.5 R; 585/13

[56] References Cited

U.S. PATENT DOCUMENTS

| | | | |
|---|---|---|---|
| Re. 26,330 | 1/1968 | Colfer | 208/48 |
| 2,353,192 | 7/1944 | Sargent et al. | 252/51.5 R |
| 2,553,441 | 5/1951 | Chenicek | 99/163 |
| 2,962,442 | 11/1960 | Andress | 252/51.5 |
| 3,034,876 | 5/1962 | Gee et al. | 44/62 |
| 3,068,083 | 12/1962 | Gee et al. | 44/70 |
| 3,132,085 | 5/1964 | Summers | 208/48 |
| 3,235,484 | 2/1966 | Colfer | 208/48 |
| 3,269,810 | 8/1966 | Chemot | 44/62 |
| 3,355,270 | 11/1967 | Amick et al. | 44/68 |
| 3,368,972 | 2/1968 | Otto | 252/51.5 R |
| 3,437,583 | 4/1969 | Gonzales | 208/48 |
| 3,442,791 | 5/1969 | Gonzales | 208/48 |
| 3,756,943 | 9/1973 | Hopkins et al. | 308/48 AA |
| 3,787,458 | 1/1974 | Piasek et al. | 252/51.5 R |
| 3,980,569 | 9/1976 | Pindar et al. | 252/51.5 R |
| 3,985,802 | 10/1976 | Piasek et al. | 252/51.5 R |
| 4,020,048 | 4/1977 | Herrop | 260/51.5 |
| 4,032,304 | 6/1977 | Dorer et al. | 44/58 |
| 4,157,308 | 6/1979 | Wilgus et al. | 252/51.5 R |
| 4,157,309 | 6/1979 | Wilgus et al. | 252/51.5 R |
| 4,166,726 | 9/1979 | Harle | 44/73 |
| 4,170,562 | 10/1979 | West | 252/51.5 R |
| 4,200,545 | 4/1980 | Clason et al. | 252/51.5 R |

FOREIGN PATENT DOCUMENTS

| | | |
|---|---|---|
| 1158076 | 7/1969 | United Kingdom . |

*Primary Examiner*—H. M. S. Sneed
*Assistant Examiner*—Helane Myers
*Attorney, Agent, or Firm*—Alexander D. Ricci; Roslyn T. Tobe

[57] ABSTRACT

Alkoxylated Mannich product compositions and methods of use of same as process antifoulants are disclosed. The alkoxylated Mannich products deactivate metals and inhibit oxygen promoted polymerization in hydrocarbons and petrochemicals.

16 Claims, No Drawings

BIFUNCTIONAL ANTIFOULANT COMPOSITIONS AND METHODS

FIELD OF THE INVENTION

The present invention pertains to compositions and methods for providing antifouling protection for petroleum hydrocarbons or petrochemicals during processing thereof at elevated temperatures. The compositions and methods also serve to deactivate metals in contact with the aforementioned process streams and to inhibit oxygen based polymerization of certain process fluid constituents.

BACKGROUND

In the processing of petroleum hydrocarbons and feedstocks such as petroleum processing intermediates, and petrochemicals and petrochemical intermediates, e.g., gas, oils and reformer stocks, chlorinated hydrocarbons and olefin plant fluids such as deethanizer bottoms, the hydrocarbons are commonly heated to temperatures of 100 to 1000° F. (most commonly 500°-1000° F.). Similarly, such petroleum hydrocarbons are frequently employed as heating mediums on the "hot side" of heating and heat exchange systems. In both instances, the petroleum hydrocarbon liquids are subjected to elevated temperatures which produce a separate phase, known as fouling deposits, within the petroleum hydrocarbons. In all cases, these deposits are undesirable by-products. In many processes, the deposits reduce the bore of conduits and vessels to impede process throughput, impair thermal transfer, and clog filter screens, valves and traps. In the case of heat exchange systems, the deposits form an insulating layer upon the available surfaces to restrict heat transfer and necessitate frequent shutdowns for cleaning. Moreover, these deposits reduce throughput, which, of course, results in a loss of capacity with a drastic effect in the yield of finished product. Accordingly, these deposits have caused considerable concern to the industry.

Organic foulants are usually higher molecular weight materials ranging in consistency from that of tar to rubber to "popcorn" to "coke." The exact composition of such foulants is difficult to identify.

One particularly troublesome type of organic fouling is caused by the formation of polymers that are insoluble in the hydrocarbon or petrochemical fluid being processed. The polymers are usually formed by reactions of unsaturated hydrocarbons, although any hydrocarbon can polymerize. Generally, olefins tend to polymerize more readily than aromatics, which in turn polymerize more readily than paraffins. Trace organic materials containing hetero atoms such as nitrogen, oxygen and sulfur also contribute to polymerization.

Polymers are formed by free radical chain reactions. These reactions, shown below, consist of two phases, an initiation phase and a propagation phase. In reaction 1, the chain initiation reaction, a free radical represented by R°, is formed (the symbol R can be any hydrocarbon). These free radicals, which have an odd electron, act as chain carriers. During chain propagation, additional free radicals are formed and the hydrocarbon molecules (R°) grow larger and larger (see reaction 2c), forming the unwanted polymers which accumulate on heat transfer surfaces.

Chain reactions can be triggered in several ways. In reaction 1, heat starts the chain. Example: when a reactive molecule such as an olefin or a diolefin is heated, a free radical is produced. Another way a chain reaction starts is shown in reaction 3. Here, metal ions initiate free radical formation. Accelerating polymerization by oxygen and metals can be seen by reviewing reactions 2 and 3.

1. Chain Initiation $$R{-}H \rightarrow R^{\circ} + H^{\circ}$$

2. Chain Propagation a. $R^{\circ} + O_2 \rightarrow R{-}O{-}O^{\circ}$ b. $R{-}O{-}O^{\circ} + R'{-}H \rightarrow R'^{\circ} + R{-}O{-}O{-}H$ c. 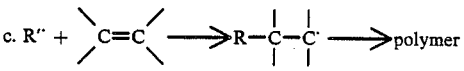

3. Chain Initiation a. $Me^{++} + RH \rightarrow Me^{+} + R^{\circ} + H^{+}$ b. $Me^{++} + R{-}O{-}O{-}H \rightarrow Me^{+} + R{-}O{-}O^{\circ} + H^{+}$ 4. Chain Termination a. $R^{\circ} + R'^{\circ} \rightarrow R{-}R'$ b. $R^{\circ} + R{-}O{-}O^{\circ} \rightarrow R{-}O{-}O{-}R$ Research indicates that even very small amounts of oxygen can cause or accelerate polymerization. Accordingly, to inhibit this insidious fouling problem, it is highly desirable to provide a polyfunctional process antifoulant which can, among other functions, inhibit oxygen based polymerization initiation. This antioxidant function serves as a "chain-stopper" by forming inert molecules with the oxidized free radical hydrocarbons, in accordance with the following reaction:

Chain Termination $$ROO^{\circ} + \text{Antioxidant} \rightarrow ROOH + \text{Antioxidant } (-H^{\circ})$$

$$\text{Antioxidant } (-H^{\circ}) \rightarrow \text{inert products}$$

In addition to the desirability of inhibiting oxygen based polymerization, it is highly desirable to inhibit the catalytic formation of gummy deposits and the like which are caused by metallic impurities, such as copper and/or iron, which may be present in the process fluids. These types of antifoulants are referred to as "metals coordinators" or "metal deactivators" and function by forming a complex or ligand with the metallic impurity in the process fluid.

Unlike organic deposits, inorganic deposits can be simple to identify. Inorganic deposits include, e.g., metallic salts, oxides, sulfides, etc. of iron, copper and vanadium. Such deposits may be present in the original feed as "ash" or they may be the result of corrosion or precipitation in equipment where fouling is evident.

There are many areas in the hydrocarbon processing industry where antifoulants have been used successfully; the main treatment areas are discussed below.

In a refinery, the crude unit has been the focus of attention, especially because of fuel cost. Antifoulants have been successfully applied at the exchangers; downstream and upstream of the desalter, on the product side of the preheat train, on both sides of the desalter makeup water exchanger, and at the sour water stripper.

Hydrodesulfurization units of all types experience preheat fouling problems. Among those that have been successfully treated are reformer pretreaters processing both straight run and coker naphtha, desulfurizers processing catalytically cracked and coker gas oils, and distillate hydrotreaters.

Cat cracker preheat exchanger fouling, both at the vacuum column and at the cat cracker itself, has also been corrected by the use of antifoulants.

Chlorinated hydrocarbon plants, such as VCM, EDC and perchloroethane and trichloroethane have also experienced various types of fouling problems.

The present invention is directed toward bifunctional anti-foulant methods and compositions which are useful in controlling fouling encountered in petroleum and petrochemical systems as described supra. More specifically, these compositions and methods, due to their bifunctional attributes, may be applied effectively to inhibit fouling caused by oxygen-based free radical formation and/or metal catalysis.

SUMMARY OF THE INVENTION

In accordance with the invention, metals deactivation and antioxidant activity are demonstrated by the use of certain alkoxylated Mannich products. These alkoxylated Mannich products are formed via reaction of the reactants (A), (B) and (C); wherein (A) is an alkoxylated phenol of the structure

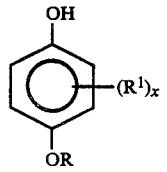

FORMULA I wherein R is $C_1$–$C_{10}$ alkyl, $R^1$ is selected from alkyl, aryl, alkaryl, or arylalkyl of from about 1 to 20 carbon atoms, x is 0 or 1; (B) is a polyamine of the structure $$H_2N(\underset{\underset{R_2}{|}}{CH}-(CH_2)_y-\underset{\underset{R_3}{|}}{CH}-NH)_zH$$

FORMULA II wherein Z is a positive integer, $R_2$ and $R_3$ may be the same or different and are independently selected from H, alkyl, aryl, aralkyl, or alkaryl having from 1 to 20 carbon atoms, y may be 0 or 1; and wherein (C) is an aldehyde of the structure $$R_4-\overset{\overset{O}{\|}}{C}-H$$

FORMULA III wherein $R_4$ is selected from hydrogen and alkyl having from 1 to 6 carbon atoms.

PRIOR ART

Schiff bases such as N,N'-salicylidene-1,2-diaminopropane are the most commonly used metal deactivators. In U.S. Pat. Nos. 3,034,876 and 3,068,083, the use of this Schiff base with esters were claimed as synergistic blends for the thermal stabilization of jet fuels.

Gonzales, in U.S. Pat. Nos. 3,437,583 and 3,442,791, claimed the use of N,N'-disalicylidene-1,2-diaminopropane in combination with the product from the reaction of a phenol, an amine, and an aldehyde as a synergistic antifoulant. Alone the product of reaction of the phenol, amine, and aldehyde had little, if any, antifoulant activity.

Products from the reaction of a phenol, an amine, and an aldehyde (known as Mannich-type products) have been prepared in many ways with differing results due to the method of preparation and due to the exact ratio of reactants and the structure of the reactants.

Metal chelators were prepared by a Mannich reaction in U.S. Pat. No. 3,355,270. Such chelators were reacted with copper to form a metal chelate complex which was used as a catalyst for furnace oil combustion. The activity of the copper was not decreased or deactivated by the Mannich reaction chelator.

Mannich-type products were used as dispersants in U.S. Pat. Nos. 3,235,484 and Re. 26,330 and 4,032,304 and 4,200,545. A Mannich-type product in combination with a polyalkylene amine was used to provide stability in preventing thermal degradation of fuels in U.S. Pat. No. 4,166,726.

We are not aware of any prior art disclosing the preparation of or use of the specific alkoxylated Mannich products as herein disclosed.

DETAILED DESCRIPTION OF THE INVENTION

We have found that certain alkoxylated Mannich products demonstrate superior antifoulant activity in hydrocarbons and petrochemicals when same are processed at high temperatures (e.g., 100°–1000° F., commonly 600°–1000° F.). These alkoxylated Mannich products are quite versatile in that they function to deactivate metal species and also serve as antioxidants to inhibit oxygen promoted polymerization.

Specifically, the alkoxylated Mannich-type products of the invention are formed via reaction of the reactants (A), (B) and (C) wherein (A) is an alkoxylated phenol of the structure

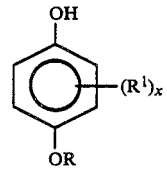

FORMULA I wherein R is $C_1$–$C_{10}$ alkyl, $R^1$ is selected from alkyl, aryl, alkaryl, or arylalkyl of from about 1 to 20 carbon atoms, x is 0 or 1; (B) is a polyamine of the structure $$H_2N(\underset{\underset{R_2}{|}}{CH}-(CH_2)_y-\underset{\underset{R_3}{|}}{CH}-NH)_zH$$

FORMULA II wherein Z is a positive integer, $R_2$ and $R_3$ may be the same or different and are independently selected from H, alkyl, aryl, aralkyl, or alkaryl having from 1 to 20 carbon atoms, y may be 0 or 1; and wherein (C) is an aldehyde of the structure $$R_4-\overset{\overset{O}{\|}}{C}-H$$

FORMULA III wherein $R_4$ is selected from hydrogen and alkyl having from 1 to 6 carbon atoms.

As to exemplary compounds falling within the scope of Formula I supra., p-methoxyphenol (MEHQ) and p-methoxy-o-tert-butylphenol (BHA) may be mentioned. Both of these reactants (A) are commercially available.

Exemplary polyamines which can be used in accordance with Formula II include ethylenediamine, propylenediamine, diethylenetriamine, triethylenetetramine, tetraethylenepentamine and the like, with ethylenediamine and triethylenetetramine being preferred.

The aldehyde component can comprise, for example, formaldehyde, acetaldehyde, propanaldehyde, butrylaldehyde, hexaldehyde, heptaldehyde, etc. with the most preferred being formaldehyde which may be used in its monomeric form, or, more conveniently, in its polymer form (i.e., paraformaldehyde).

As is conventional in the art, the Mannich condensation reaction may proceed at temperatures from about 50° to 200° C. with a preferred temperature range being about 75°–175° C. As is stated in U.S. Pat. No. 4,166,726, the time required for completion of the reaction usually varies from about 1–8 hours, varying of course with the specific reactants chosen and the reaction temperature.

As to the molar range of components (A):(B):(C) which may be used, this may fall within 0.5–5:1:0.5–5. The preferred range is 2–4:1:2–4.

The alkoxylated Mannich product antifoulants of the invention may be dispersed within the hydrocarbon medium within the range of 0.05 to 50,000 ppm based upon one million parts of the hydrocarbon medium. Preferably, they are added in an amount from about 1 to 1,000 ppm.

In one typical synthetic procedure, o-t-butyl-p-hydroxyanisole (18.03 g), ethylenediamine (1.5 g), paraformaldehyde (3.3 g), and xylene (75 g) were charged into a three-necked flask and heated to 150° C. The theoretical amount of water was removed by azeotroping by use of a dean-stark trap. After about 3.5 hours, the reaction mixture was cooled. The resulting product contained about 40% alkoxylated Mannich product and about 60% xylene.

EXAMPLES

The invention will now be further described with reference to a number of specific examples which are to be regarded solely as illustrative and not as restricting the scope of the invention.

Test Methods Utilized

Three test methods were employed to show the antifouling versatility of the alkoxylated Mannich products of the invention. These were: (1) hot wire test; (2) oxygen absorption test; and (3) ASTM D-525-80.

Hot Wire Test

I. Objective: To screen preparations according to the amount of fouling protection they exhibit.

II. Method Outline: Samples treated with candidate materials are placed in hot wire apparatus and electrically heated. Fouling deposits from an untreated sample are compared with those of the treatments.

Oxygen Absorption Test

In the oxygen absorption test, a metal compound, N,N-diethylhydroxylamine (DEHA), a basic amine, and the candidate metal chelator are placed in an autoclave and 50 to 100 psig of oxygen over-pressure is charged to the autoclave. The change in pressure versus time is recorded. With only the metal compound, DEHA, and a basic amine present, absorption of oxygen occurs. A metal deactivator in the reaction will chelate the metal in such a way to inhibit the oxygen absorption. The less the pressure drop, the better the metal deactivator.

A typical test used 1.25 g of a 6% copper naphthenate solution, 5.6 g of DEHA, 5.6 g of N-(2 aminoethyl)piperazine, 12.5 g of heavy aromatic naphtha as solvent, and about 2 g of metal chelator. Pressure drops of from 0 to 48 psig were found over a 60 minute time period. With metal species absent, oxygen was not absorbed.

ASTM D-525-80

In the ASTM test, a sample of a feedstock known to polymerize is placed in an autoclave with a metal compound, an antioxidant, and a metal chelator. An overpressure of 100 psig of oxygen is added and the apparatus is heated on a hot water bath to 100° C. until a drop in pressure is noted signifying the loss of antioxidant activity. The longer the time until a drop in pressure occurs, the more effective the antioxidant and/or metal deactivator.

TABLE I

Hot Wire and ASTM D-525-80 on a Pyrolysis Gasoline Feedstock

| Test Material | Hot Wire Test (Level Where no Deposit Observed) | ASTM D-525-80 (Induction Time) |
|---|---|---|
| 1. None | None | 15 min. |
| 2. t-butylhydroxyanisole (BHA), triethylene tetramine (TETA), paraformaldehyde (PF) 2:1:2 (molar ratio of reactants) | 240 | 35 min. |
| 3. BHA - ethylenediamine (EDA) - PF 2:1:2 | 200 | 30 min. |
| 4. p-methoxyphenol - TETA - PF 2:1:2 | 200 | 25 min. |
| 5. BHA - EDA - PF 4:1:4 | 205 | 40 min. |
| 6. N,N'—disalicylidene-1,2-cyclohexane (commercially available metal deactivator)(MD) | 200 | — |

TABLE II

Hot Wire, Oxygen Absorption, ASTM D-525-80

| Phenol | Polyamine | Ratio | Amount of Actives | Result |
|---|---|---|---|---|
| | | Hot Wire Data | | |
| None | None | None | None | 7.5 mg avg. |
| Nonyl | EDA | 4-1-4 | 220 ppm | 3.0 avg. |
| BHA | EDA | 4-1-4 | 200 ppm | 0.0 |
| Nonyl | EDA | 2-1-2 | 220 ppm | 2.6 |
| BHA | EDA | 2-1-2 | 200 ppm | 1.0 |
| BHA | TETA | 2-1-2 | 200 ppm | 1.0 |
| MEHQ | TETA | 2-1-2 | 200 ppm | 1.5 |
| | | Oxygen Absorption Data | | Δpsi |
| None | None | None | None | 48, 48 |
| Nonyl | EDA | 4-1-4 | 2.0 g | 21 |
| MEHQ | TETA | 4-1-4 | 2.0 g | 20, 17 |
| MEHQ | TETA | 4-1-4 | 4.0 g | 7 |
| Nonyl | EDA | 2-1-2 | 2.0 g | 17 |
| MEHQ | TETA | 2-1-2 | 2.0 g | 2, 1.5, 6 |
| BHA | EDA | 2-1-2 | 2.0 g | 34, 33 |
| BHA | EDA | 2-1-2 | 2.5 g | 39, 29 |
| BHA | TETA | 2-1-2 | 2.3 g | 28, 30 |
| | | ASTM D-525 Data | | Induction |

TABLE II-continued

| Hot Wire, Oxygen Absorption, ASTM D-525-80 | | | | |
|---|---|---|---|---|
| Phenol | Polyamine | Ratio | Amount of Actives | |
| None | None | None | None | 25, 26 min. |
| Nonyl | TETA | 1-1-2 | 200 ppm | 27 min. |
| BHA | EDA | 2-1-2 | 200 ppm | 81 min. |
| MD | — | — | 120 ppm | 26 min. |

BHA = butylated p-methoxyphenol (o-t-butyl-p-methoxyphenol)
MEHQ = p-methoxyphenol
EDA = ethylenediamine
TETA = triethylene tetramine Additional hot wire tests using 80 ppm of copper naphthenate were undertaken with respect to several of the alkoxylated Mannich products of the invention and several comparative materials. Results are shown in Table III.

TABLE III

| Material | Ratio Phenol-Ethylenediamine (EDA)-F | Concentration (ppm) Actives | Coke (mg) |
|---|---|---|---|
| None | — | — | 7.5 (avg of 6) |
| p-t-butyl- | 2-1-2 | 350 | 0 |
| p-nonyl- | 4-1-4 | 220,220,400,800 | 3.1,2.9,1.5,1 |
| p-nonyl- | 2-1-2 | 220,400 | 2.6,1.9 |
| p-dodecyl- | 4-1-4 | 520 | 0 |
| p-methoxy-o-t-butyl- | 4-1-4 | 200 | 0 |
| p-methoxy-o-t-butyl- | 2-1-2 | 200 | 1.0 |
| PHENOL-TETA-PARAFORMALDEHYDE | | | |
| p-methoxy- | 2-1-2 | 200 | 1 |
| p-methoxy-o-t-butyl- | 2-1-2 | 200 | 1.5 |
| N,N'—disalicylidene-1,2-cyclohexane | — | 200 | 0 |

TABLE IV

| Oxygen Absorption Data | | | | |
|---|---|---|---|---|
| Phenol | Amine | Phenol-Amine-Formaldehyde (Molar Ratio) | m mols | ΔP |
| None | None | — | — | 48,48 |
| N,N'—disalicylidene-1,2-cyclohexane | | — | 2.5 | 7,5 |
| p-nonyl- | EDA | 2-1-2 | 0.8 | 17,48[a] |
| | | | 2.3 | 5 |
| p-nonyl- | EDA | 4-1-4 | 2.0 | 6 |
| p-methoxy-o-t-butyl- | TETA | 2-1-2 | 1.5 | 48[a] |

[a]Probable leak in autoclave

Based on the above laboratory data, it is presently preferred to use p-methoxyphenol—triethylenetetramine—PF in a molar ratio of components of 2:1:2.

The above data demonstrate the superior antifoulant characteristics of the alkoxylated Mannich products of the invention by reason of the superior performance of the materials in the hot wire tests. The oxygen data indicates that the materials are good metal deactivators, whereas the ASTM 525 test indicates that the materials provide significant antioxidant activity.

Reasonable variations and modifications will be apparent to those skilled in the art and can be made without departing from the spirit and scope of the invention.

We claim:

1. In a method of inhibiting fouling in a hydrocarbon medium, already having transition metal species impurities therein which, if untreated, would tend to form gummy deposits and the like within said hydrocarbon medium, the improvement comprising deactivating said transition metal impurities by dispersing within said hydrocarbon medium, from about 0.05–50,000 ppm of an effective alkoxylated Mannich product formed from reactants (A): (B): (C) wherein (A) is an alkoxylated phenol of the structure

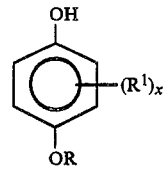

FORMULA I wherein R is $C_1$–$C_1n$ alkyl, $R^1$ is selected from alkyl, aryl, alkaryl, or arylalkyl of from about 1 to 20 carbon atoms, x is 0 or 1; (B) is a polyamine of the structure $$H_2N(\underset{\underset{R_2}{|}}{CH}-(CH_2)_y-\underset{\underset{R_3}{|}}{CH}-NH)_2H$$

FORMULA II wherein 2 is a positive integer, $R_2$ and $R_3$ may be the same or different and are independently selected from H, alkyl, aryl, aralkyl, or alkaryl having from 1 to 20 carbon atoms, y may be 0 or 1; and wherein (C) is an aldehyde of the structure $$R_4-\overset{\overset{O}{\|}}{C}-H$$

FORMULA III wherein $R_4$ is selected from hydrogen and alkyl having from 1 to 6 carbon atoms.

2. A method as recited in claim 1 wherein R is methyl.

3. A method as recited in claim 2 wherein x is 1 and wherein $R^1$ is tert-butyl.

4. A method as recited in claim 1 wherein from about 1 to 1000 ppm of said alkoxylated Mannich product is dispersed within said hydrocarbon medium.

5. A method as recited in claim 1 wherein the molar ratio of reactants (A):(B):(C) is within the range of from 2–4:1:2–4.

6. A method as recited in claim 1 wherein (A) comprises a member selected from the group consisting of p-methoxyphenol and p-methoxy-o-tert-butylphenol.

7. A method as recited in claim 1 wherein said polyamine (B) comprises a member selected from the group consisting of ethylenediamine, propylenediamine, diethylenetriamine, triethylenetetramine, and tetraethylenepentamine.

8. A method as recited in claim 7 wherein said polyamine (B) comprises ethylenediamine.

9. A method as recited in claim 7 wherein said polyamine (B) comprises triethylenetetramine.

10. A method as recited in claim 1 wherein said aldehyde (C) comprises a member selected from the group consisting of formaldehyde and paraformaldehyde.

11. A method as recited in claim 1 wherein (A) comprises p-methoxyphenol, (B) comprises triethylenetetramine or ethylenediamine and (C) comprises paraformaldehyde.

12. A method as recited in claim 11 wherein the molar ratio of reactants (A):(B):(C) is about 4:1:4.

13. A method as recited in claim 11 wherein the molar ratio of reactants (A):(B):(C) is about 2:1:2.

14. A method as recited in claim 1 wherein (A) comprises p-methoxy-o-tert-butylphenol, (B) comprises triethylenetetramine or ethylenediamine, and (C) comprises paraformaldehyde.

15. A method as recited in claim 14 wherein the molar ratio of reactants (A):(B):(C) is about 4:1:4.

16. A method as recited in claim 14 wherein the molar ratio of reactants (A):(B):(C) is about 2:1:2.

* * * * *